US005848832A

United States Patent [19]

Hsieh

[11] Patent Number: 5,848,832

[45] Date of Patent: Dec. 15, 1998

[54] RATCHET WRENCH WITH LIGHTING MEANS

[76] Inventor: Chih-Ching Hsieh, No. 64, Lane 107, Liang Tsun Rd., Fong Yuan City, Taichung Hsien, Taiwan

[21] Appl. No.: 71,956

[22] Filed: May 5, 1998

[51] Int. Cl.[6] ..... B25B 23/18

[52] U.S. Cl. ..... 362/119; 362/120; 362/206

[58] Field of Search ..... 362/109, 119, 362/120, 253, 157, 206

[56] References Cited

U.S. PATENT DOCUMENTS 4,253,134 2/1981 Barnaby ..... 362/119

5,477,434 12/1995 Reed ..... 362/119

*Primary Examiner*—Stephen F. Husar

*Attorney, Agent, or Firm*—Varndell Legal Group

[57] ABSTRACT

A ratchet wrench includes a hollow guide a shaft supported on a spring inside a hollow ratchet unit of the wrench to hold a lamp assembly, a battery set, an electrically conductive plate and a knob, the knob having an outer thread threaded into an inner thread at one end of the hollow shaft, the knob being a rotated clockwise/counter-clockwise to close/open the circuit so as to turn on/off the lamp assembly.

2 Claims, 3 Drawing Sheets

RATCHET WRENCH WITH LIGHTING MEANS

BACKGROUND AND SUMMARY OF THE INVENTION

The present invention relates to a ratchet wrench, and more particularly to such a ratchet wrench with lighting means.

A variety of ratchet wrenches have been disclosed, and have appeared on the market. These ratchet wrenches are functional, however they are not practical for use in a dark place. When using a ratchet wrench in a dark place, a flash light is required to provide illumination. However, it is inconvenient to operate a ratchet wrench with one hand when the other hand holding a flash light.

It is the main object of the present invention to provide a ratchet wrench which has a lighting unit mounted in the ratchet unit thereof for providing illumination during the opration of the ratchet wrench. It is another object of the present invention to provide a ratchet wrench with lighting means which is controlled to emit light by rotating a control knob.

DETAILED DESCRIPTION OF THE PREFERRED EMBODIMENT

Figure 1:
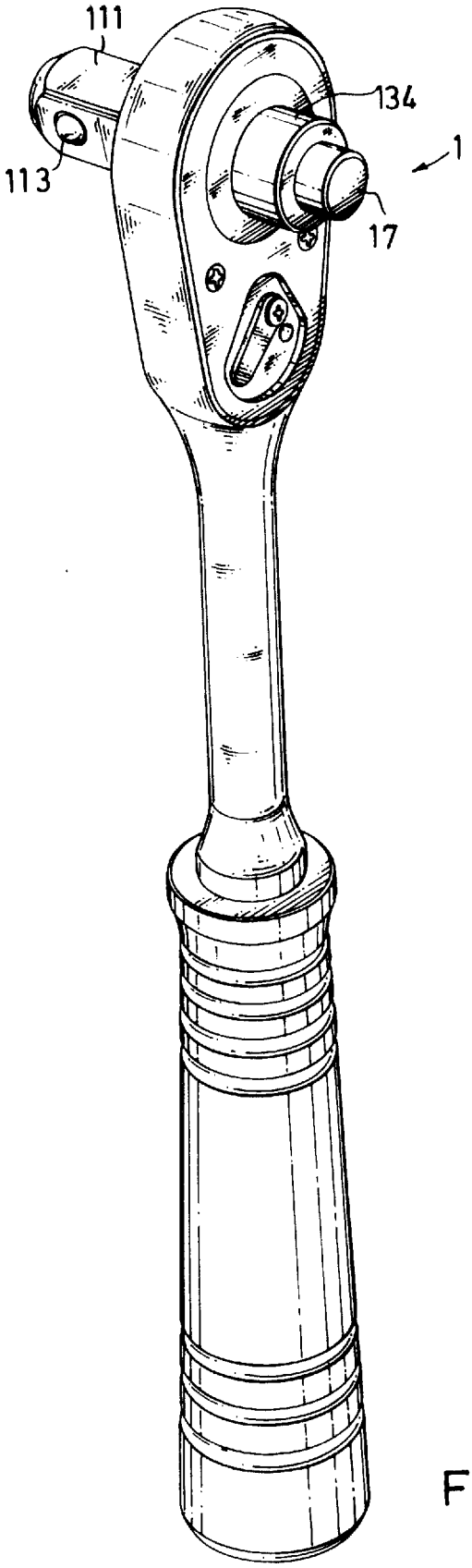
FIG. 1 is a perspective view of a ratchet wrench according to the present invention.
Figure 3:
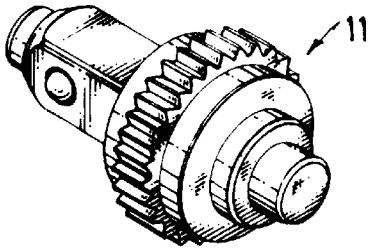
FIG. 3 is a perspective assembly view of FIG. 2.
Figure 2:
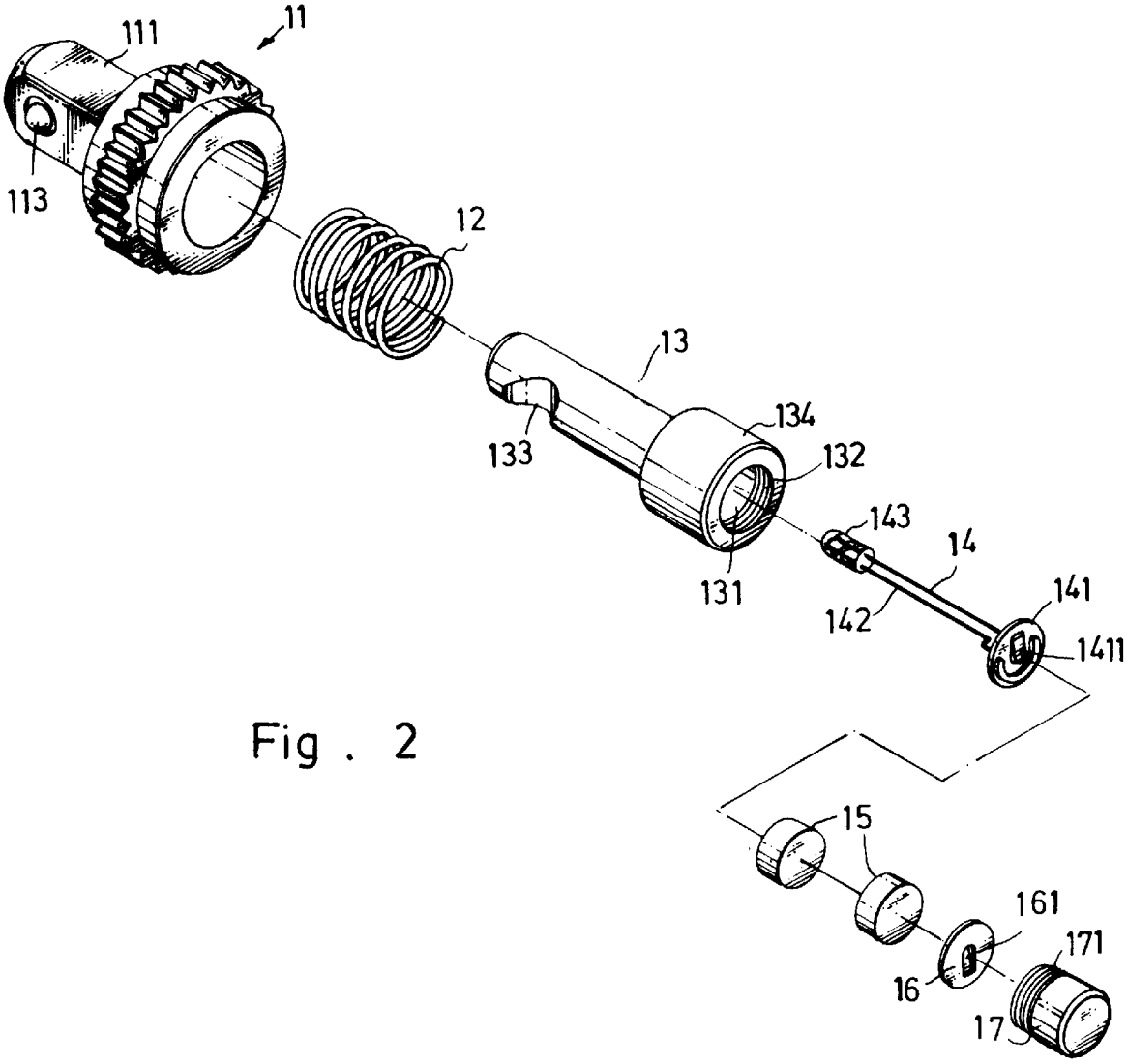
FIG. 2 is an exploded view of the lighting unit and the ratchet unit according to the present invention.

Referring to Figures from 1 to 5, a ratchet wrench 1 is shown comprising a hollow ratchet unit, which comprises a metal ratchet wheel 11 and a coupling shaft 111 integral with the ratchet wheel at one side, and a light unit, which is comprised of a metal spring 12, a hollow guide shaft 13, a lamp assembly 14, battery cells 15, a metal contact plate 16, and a knob 17. The lighting unit is mounted in (the stepped longitudinal center through hole of) the hollow ratchet unit. The coupling shaft 111 has a side hole 112, and a steel ball 113 revolvably supported in the side hole 112.

The hollow guide shaft 13 comprises a recessed portion 133 at the periphery near one end, which receives the steel ball 113, a head 134 at an opposite end, a receiving chamber 131 defined within the head 134, and an inner thread 132 inside the receiving chamber 131. The hollow guide shaft 13 is mounted in the stepped longitudinal center through hole of the hollow ratchet unit. The metal spring 12 is mounted around the hollow guide shaft 13 within the ratchet wheel 11, imparting an upward pressure to the head 134. The lamp assembly 14 is mounted in the hollow guide shaft 13, comprises of a lamp bulb 143 at one end, a metal contact plate 141 at an opposite end, a projecting strip 1411 integral with the metal contact plate 141, and lead wires 142 connected between the lamp bulb 143 and the metal contact plate 141. The battery cells 15 are mounted in the receiving chamber 131 and supported on the projecting strip 1411 of the lamp assembly 14. The knob 17 has an outer thread 171 threaded into the inner thread 132 on the hollow guide shaft 13. The metal contact plate 16 is retained between the knob 17 and the battery cells 15, having a projecting strip 161 stopped against the battery cells 15.

Figure 5:
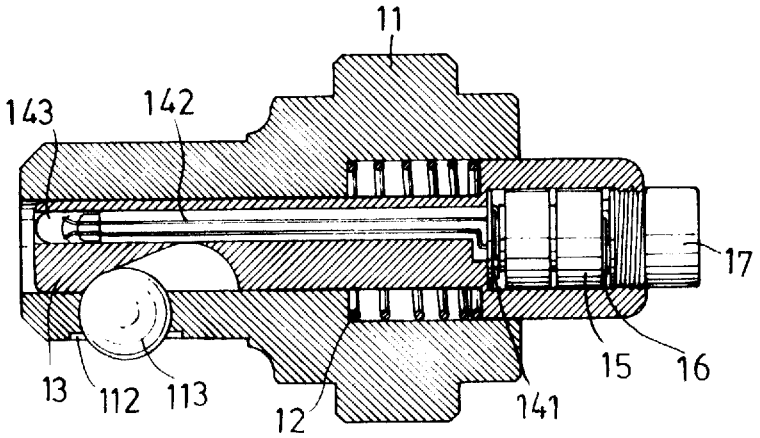
FIG. 5 is another sectional view of the present invention, showing the lighting unit set at "OFF" position.
Figure 4:
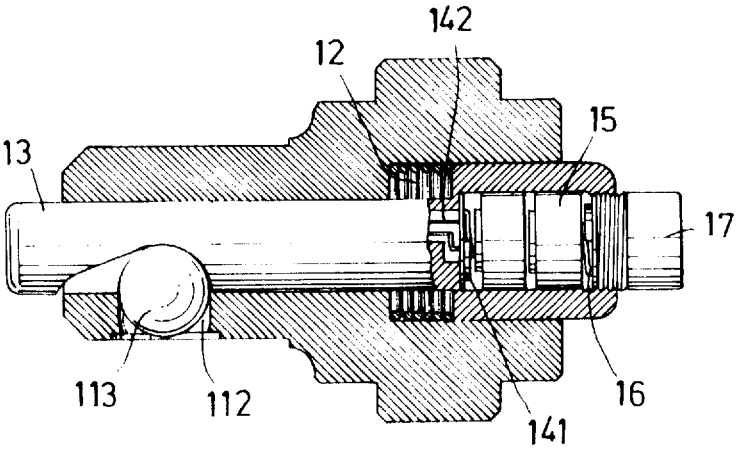
FIG. 4 is a sectional elevation of the present invention, showing the lighting unit set at "ON" position.

Referring to FIGS. 4 and 5 again, when the knob 17 is screwed inwards, the hollow guide shaft 13 is forced inwards and partially extended out of the front end of the coupling shaft 111, and at the same time the lamp assembly 14 is electrically connected to turn on the lamp bulb 143 (see FIG. 4). On the contrary, when the knob 17 is rotated in the reversed direction, the hollow guide shaft 13 is pushed back by the spring 12, and the lamp assembly 14 is electrically disconnected to turn off the lamp bulb 143 (see FIG. 5).

I claim:

1. A ratchet wrench comprising a hollow ratchet unit having a coupling shaft at one end and a steel ball revolvably supported in a side hole on said coupling shaft, and a lighting unit mounted in said hollow ratchet unit and controlled to emit light, wherein said lighting unit comprises:

a hollow guide shaft mounted in said hollow ratchet unit, said hollow guide shaft comprising a recessed portion at the periphery near one end thereof, which receives said stell ball, a head at an opposite end, a receving chamber defined within said head, said receiving chamber having a narrow bottom end longitudinally extended through said hollow guide shaft, and an inner thread inside said receiving chamber;

a metal spring mounted around said hollow guide shaft inside said hollow ratchet unit, said metal spring imparting an upward pressure to the head of said hollow guide shaft;

a lamp assembly mounted in said hollow guide shaft, said lamp assembly comprising a lamp bulb at one end, a metal contact plate at an opposite end, said metal contact plate comprising a projecting strip, a projecting strip integral with said metal contact plate, and lead wires connected between said lamp bulb and said metal contact plate;

a battery set mounted in the receiving chamber of said hollow guide shaft and supported on the projecting strip of said metal contact plate of said lamp assembly;

an electrically conductive plate mounted inside the receiving chamber of said hollow guide shaft, said electrically conductive plate having a projecting strip stopped against one end of said battery set opposite to said metal contact plate of said lamp assembly; and a knob having an outer thread threaded into the inner thread of said hollow guide shaft, said knob being rotated to turn on/off said lamp assembly.

2. The ratchet wrench of claim 1 wherein said battery set is comprised of a plurality of battery cells.

* * * * *